United States Patent [19]

Mikami et al.

[11] Patent Number: 5,018,284

[45] Date of Patent: May 28, 1991

[54] SNOW PLOW FOR VEHICLES

[75] Inventors: Shiro Mikami, Sapporo; Seiju Ooshima, Asahikawa; Yoshio Nagahara, Kushiro, all of Japan

[73] Assignee: Japan as represented by Director of Construction Machinery Works of Hokkaido Development Bureau, Hokkaido, Japan

[21] Appl. No.: 269,185

[22] PCT Filed: Mar. 31, 1987

[86] PCT No.: PCT/JP87/00198

§ 371 Date: Dec. 19, 1988

§ 102(e) Date: Dec. 19, 1988

[87] PCT Pub. No.: WO88/07607

PCT Pub. Date: Oct. 6, 1988

[51] Int. Cl.[5] ..... E01H 5/04

[52] U.S. Cl. ..... 37/233; 37/234; 37/266; 37/279

[58] Field of Search ..... 37/232, 233, 234, 266, 37/279, 281, 283

[56] References Cited

U.S. PATENT DOCUMENTS 4,019,587 4/1977 Meisel, Jr. ..... 37/279 X
4,552,226 11/1985 Platter ..... 37/279 X

FOREIGN PATENT DOCUMENTS 51-46436 4/1976 Japan .
56-17543 4/1981 Japan .

*Primary Examiner*—Dennis L. Taylor
*Assistant Examiner*—J. Russell McBee

[57] ABSTRACT

To the front of the snow removing vehicle, a snow plow having a variable curved surface is mounted. The curved surface of the plow is varied by use of universal joints and telescopic cylinders. The curved surface of the plow is varied according to the snow removal conditions.

6 Claims, 5 Drawing Sheets

SNOW PLOW FOR VEHICLES

TECHNICAL FIELD

This invention relates to a snow plow having a variable curved surface which is mounted in front of a vehicle for removing the snow.

BACKGROUND ART

A conventional snow plow for vehicles has a metallic rigid body structure having a predetermined curved surface, as shown in FIGS. 1 and 2.

In such a conventional snow plow having a rigid body structure, the thrust angle (the edge angle $\theta_1$, the back angle $\theta_2$), as shown in FIG. 3; the cutting angle $\theta_3$, the snow throwing angle $\theta_4$, the length L of the flat portion 5, the radius of curvature R and the height H of the curved portion 6 as shown in FIG. 4; and the size B of the snow cleaning orifice 7 as shown in FIG. 5 are all respectively invariable.

Due to the invariability of each part mentioned above the conventional snow plow can not accommodate the various, diverse environments such as the quantity and type of the snow which is to be removed, the configuration of the road, the speed of the snow removing vehicle and the atmospheric condition. Also due to invariability of the cutting angle $\theta_3$, the breaking ability of the conventional snow plow results in inefficiency in removing the snow and/or in difficulty in breaking the snow.

Furthermore, it is difficult to select the most efficient position for removing the maximum quantity of snow and the distance for throwing the snow can be selected only by controlling the speed of the vehicle. This is particularly important if houses are situated roadside. Therefore, a conventional snow plow is very inconvenient.

DISCLOSURE OF THE INVENTION

An object of this invention is to solve the above-mentioned problems of the conventional snow plow.

In this invention, the above mentioned problems are solved by utilizing the following constructions. Namely, a snow plow according to the invention is mounted onto a fixing member installed in front of the snow removing vehicle, and the plow is made of material which has elastic properties. In back of the plow each set is constructed with universal joints and a hydropneumatic cylinder, and the curved surface of said snow plow can be varied into the desired configuration by telescoping said telescopical cylinders. In this invention, the vehicle is an ordinary four-wheel truck, a crawler (endless chain threads) tractor, a car on rails or others.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus, are not limitative of the present invention, and wherein:

FIG. 9A is an enlarged side view of the essential part in accordance with the present invention;

DETAILED DESCRIPTION OF THE PREFERRED EMBODIMENTS

Figure 1:
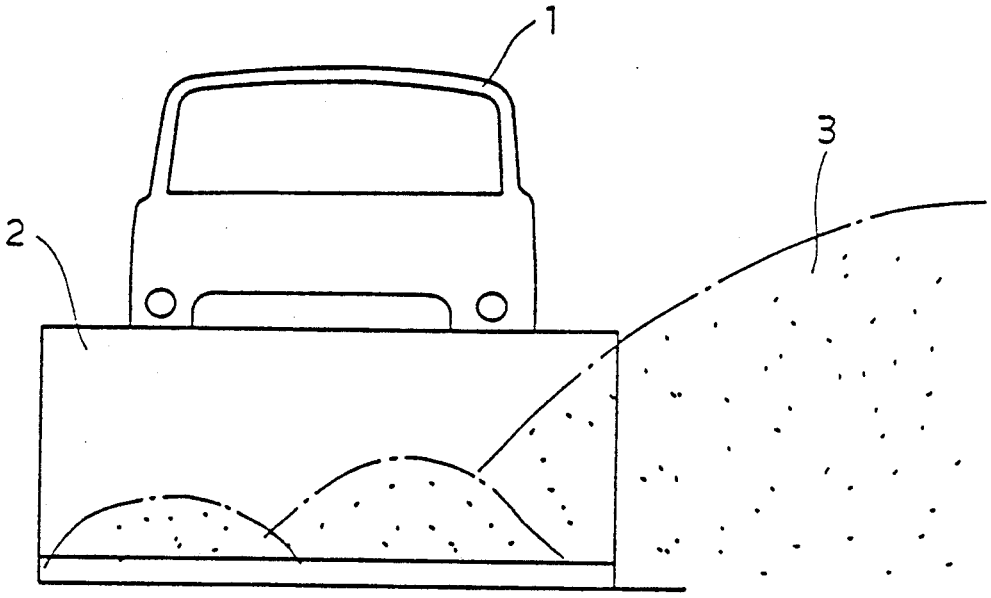
FIG. 1 PRIOR ART
FIG. 1 is a front view of a conventional snow plow mounted on a snow removing vehicle.
Figure 2:
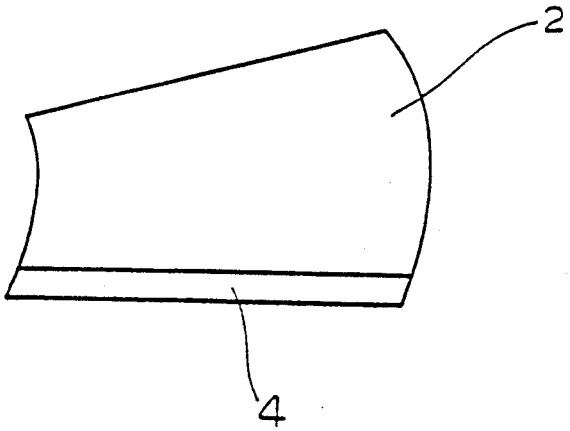
FIG. 2 PRIOR ART
FIG. 2 is a perspective view of the conventional snow plow.
Figure 3:
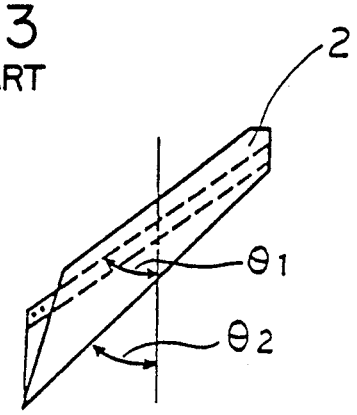
FIG. 3 PRIOR ART
FIG. 3 is a schematic plan view of the conventional snow plow.
Figure 4:
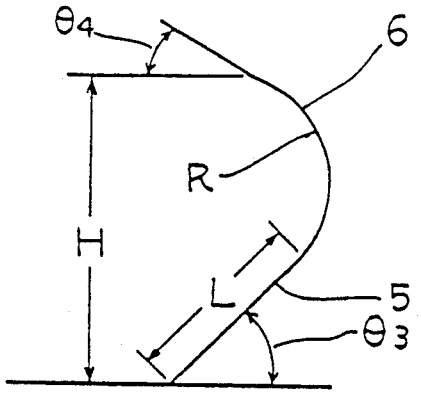
FIG. 4 PRIOR ART
FIG. 4 is a schematic side view of the conventional snow plow.
Figure 5:
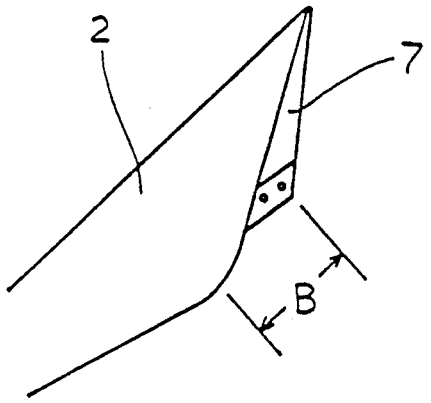
FIG. 5 PRIOR ART
FIG. 5 is a schematic plan view of the snow cleaning orifice in the conventional snow plow.
Figure 6:
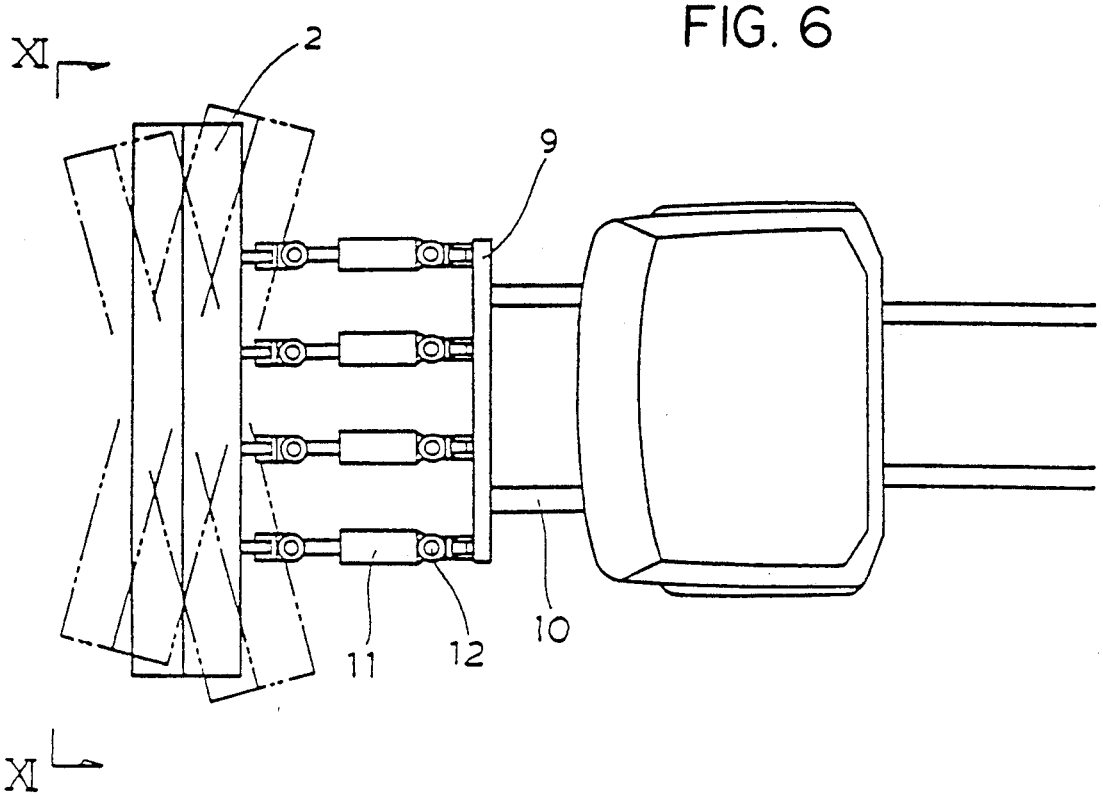
FIG. 6 is a plan view of the snow removing vehicle with a mounted snow plow having variable curved surface of the present invention.
Figure 7:
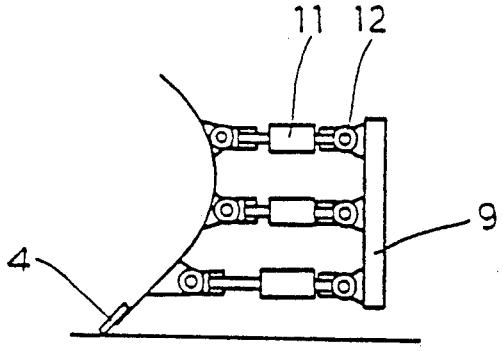
FIG. 7 is a side view of the essential part in accordance with the present invention.
Figure 8:
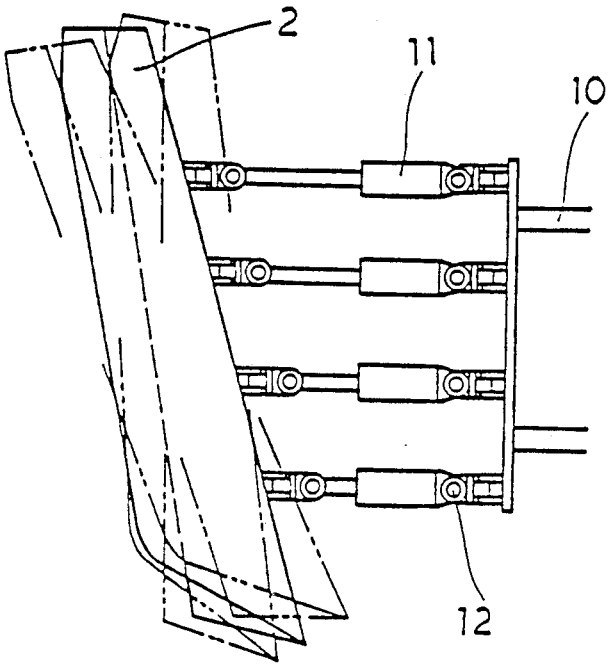
FIG. 8 is an enlarged plan view of the essential part in accordance with the present invention.
Figure 9B:
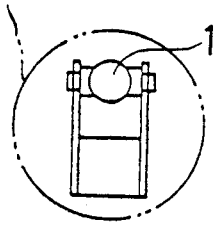
FIG. 9B is a cross-sectional view of the area indicated by circle A in FIG. 9A of the present invention.
Figure 9B:
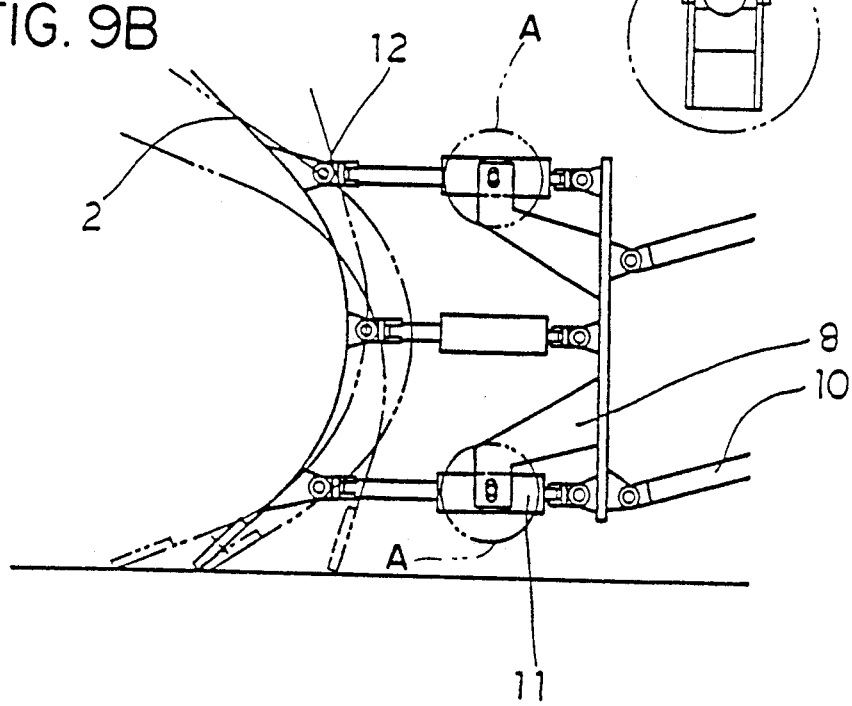

Referring to FIGS. 6 to 11, the preferred embodiments of the snow plow according to the present invention will be hereinunder described. To the snow removing vehicle (in this embodiment a truck) 1, a fixing member 9 is mounted which is supported by a mounting device 10, and the member is attached to hydropneumatic cylinders 11 through universal joints 12, and each free end of the cylinders is attached to a snow plow 2 by means of a universal joint 12.

The reference number 8 is a bracket which is mounted onto the fixing member 9 for preventing deflective movement in a transverse direction of the hydropneumatic cylinders.

The cutting edge 4 of the snow plow 2 is made of hard metallic material etc., and the body portion thereof is made of material having predetermined elastic properties such as metal, rubber, plastic, cloth, etc. The cutting edge is screwed onto a steel plate attached under brackets for fixing the cylinders.

The fixing member 9 and the snow plow 2 are connected by means of several universal joints 12 which are aligned longitudinally and laterally therebetween.

Figure 10:
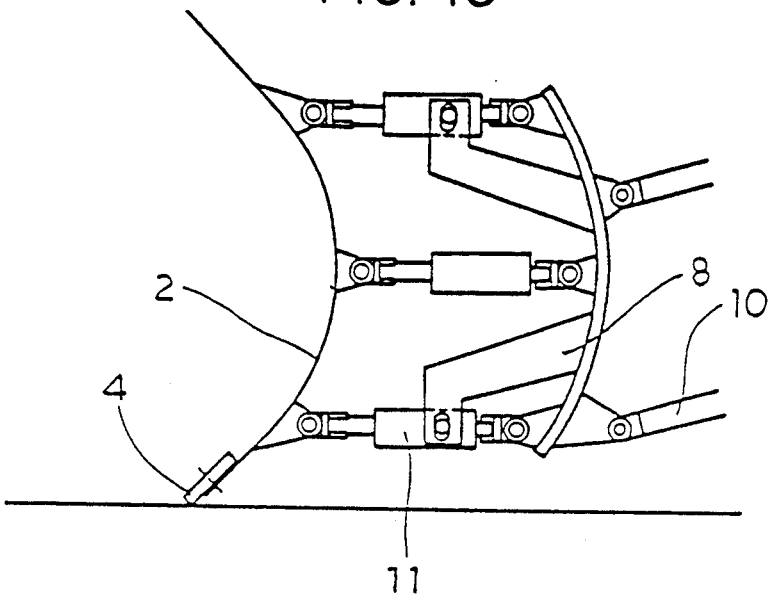
FIG. 10 is a schematic side view of the other embodiment in accordance with the present invention.
Figure 11:
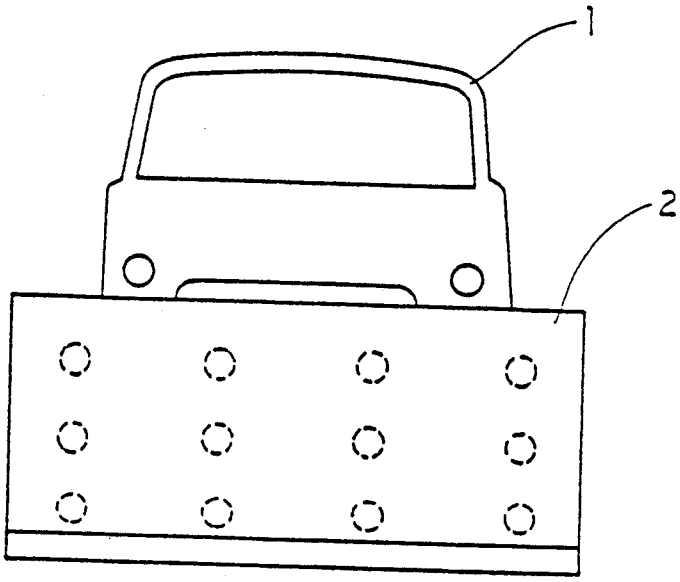
FIG. 11 is a front view looking along arrows XI—XI in FIG. 6.

As shown in FIG. 10, the configuration of the fixing member 9 may be preformed so as to correspond to plow 2.

When the snow plow is not in use, the plow 2 is supported and fixed onto a supporting arm (not shown) provided on the mounting device 10.

In this invention, by selectably telescoping the plurality of hydropneumatic cylinders 11, the snow to be cleared is thrown either to the right or left side as desired, and the curved surface of the snow plow may be varied into various configurations.

By varying the configuration of the snow plow 2 into various configuration, one can select the optimum configuration of the snow plow (the thrust angle, the cutting angle, the length of the flat portion, the size of the curved surface, the height, the size of the snow cleaning orifice, the snow throwing angle etc) corresponding to the environmental diversities such as the quantity and type of snow, the configuration of the road, the speed of the snow removing vehicle, atmospheric conditions, etc. Thereby, the snow throwing distance, height, etc. can be selected freely. Therefore, the snow removing operations can be performed efficiently and safely at a constant operational speed.

The snow plow of this invention can be utilized with an ordinary four-wheel truck, a crawler tractor, a car on rails etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A snow plow for a vehicle comprising:

a fixing member attached to the front of the vehicle;

an elastic member having a vertical axis and a horizontal axis therethrough;

means for mounting the elastic member to the fixing member; and telescopic means for deforming said elastic member to vary the configuration thereof, said elastic member being deformable about said vertical and horizontal axes by said telescopic means, said telescopic means comprise a plurality of cylinders arranged in a plurality of generally horizontal rows and generally vertical columns with each row and each column having more than one cylinder therein.

2. The snow plow as recited in claim 1, wherein said plurality of cylinders are hydropneumatic.

3. The snow plow as recited in claim 1, wherein said means for mounting comprises a plurality of universal joints.

4. The snow plow as recited in claim 1, wherein said telescopic means can move one of the top and bottom of the elastic member forwardly and can move one of a left side and a right side of the elastic member forwardly to adjust positioning of the elastic member.

5. The snow plow as recited in claim 4, wherein the elastic member has a plurality of corners and wherein the telescopic means further can move one of said corners forwardly with respect to the other corners.

6. The snow plow as recited in claim 1, wherein the elastic member has a plurality of corners and wherein the telescopic means can move one of said corners forwardly with respect to the other corners.

* * * * *